United States Patent [19]

Suganuma et al.

[11] 4,355,770

[45] Oct. 26, 1982

[54] COP SUPPLYING APPARATUS FOR AUTOMATIC WINDING MACHINE

[75] Inventors: Buro Suganuma, Nagaokakyoshi; Noboru Sekitani, Hirakatashi; Yasuaki Hatanaka; Yasuhiro Inoue, both of Nagaokakyoshi, all of Japan

[73] Assignee: Murata Kikai Kabushiki Kaisha, Japan

[21] Appl. No.: 129,364

[22] Filed: Mar. 11, 1980

[30] Foreign Application Priority Data

Mar. 13, 1979 [JP] Japan ..... 54-29653

[51] Int. Cl.[3] ..... B65H 54/26; B65H 67/02

[52] U.S. Cl. ..... 242/35.5 A

[58] Field of Search ..... 242/35.5 A, 35.5 R, 242/35.6 R, 35.6 E

[56] References Cited

U.S. PATENT DOCUMENTS 4,212,433 7/1980 Matsui et al. ..... 242/35.5 A

*Primary Examiner*—Stanley N. Gilreath

*Attorney, Agent, or Firm*—Whittemore, Hulbert & Belknap

[57] ABSTRACT

Improvements in a cop supplying apparatus comprising a cop supplying truck which runs along individual winding units of an automatic winding machine and feeds cops into magazines of the winding units without stopping. The cop supplying truck is provided with a guide and a pair of rollers for positively feeding the yarn end which is arranged under a long hole for placing cops through so that the yarn end of the cop held on a cop container is positively taken off from the cop container.

5 Claims, 7 Drawing Figures

COP SUPPLYING APPARATUS FOR AUTOMATIC WINDING MACHINE

BACKGROUND OF THE INVENTION

The applicant has previously provided an apparatus for automatically supplying the cops, which is suited for use in an automatic winding machine having winding units of the fixed type, the individual winding units being equipped with magazines. The apparatus will be illustrated referring to FIGS. 1 and 2.

A cop supplying truck 1 travels along winding units 2 of an automatic winding machine, and cops S are contained in bottom-less cop containers K. The cop containers K are delivered by belts 3 running at the same speed as that of the cop supplying truck 1, and the size of the hole is so selected that the cop container is not allowed to fall but the cop only is allowed to fall. When the cop container K is passed over a long hole 4 on the cop supplying truck 1, the cop S is dropped into magazine 5 of the winding unit through the long hole 4. More specifically, the cop supplying truck 1 runs without stopping at the individual winding units but feeds cops to magazines of the individual winding units in the state where the relative speed of the cop containers to the magazines is reduced substantially to zero.

The cop container K is composed of a cylindrical body and a posture stabilizing ring 6 is dismountably attached to the lower portion of the cop container K, and a yarn end holding member 7 such as a velvet type fastener is detachably fixed to the upper portion of the cop container K. Ordinarily the yarn end of the cop contained in the cop container K is held by a yarn end holding member 7 and is delivered in this state. When the cop drops from the cop supplying truck having the above-mentioned structure, since the yarn end YE of the cop is held by the yarn end holding member 7 as shown in FIG. 2, the cop falls into the magazine can 5 while the yarn is being unwound from the cop. The yarn spread between the yarn holding member 7 and the cop is kept in the state passing through the long hole 4 of a bottom plate 8 of the cop supplying truck. Accordingly, with the movement of the cop supplying truck 1 toward the left, the long hole 4 is moved to the left in the state where the rear end 4-1 of the long hole 4 catches the yarn thereon. Accordingly, the yarn is further unwound from the dropped cop S. Especially when the top end of the cop is located below a suction nozzle portion 9 of the magazine, the yarn is unwound from the cop very easily and since the yarn end caught on the yarn end holding member 7 of the cop container is not set free, the length of the yarn between the holding member 7 and the cop S is increased and this yarn is extended to a suction nozzle portion 11 of the subsequent magazine 10 with travel of the cop supplying truck, with the result that an undesirable phenomenon of spreading of the yarn between two adjacent magazines 5 and 10 is caused.

SUMMARY OF THE INVENTION

The present invention relates to improvements in a cop suppyling truck for supplying cops to individual winding units of an automatic winding machine.

It is a primary object of the present invention to eliminate the above mentioned defect involved in the previous invention and to provide an improved apparatus by which an unwinding of the yarn from the cop placed in the magazine is prevented.

In the present invention, a device for positively feeding yarn end comprising a yarn end guide and a pair of rollers for positively feeding the yarn end is arranged under the long hole 4 through which cops are placed in magazines. According to the present invention, unwinding of the yarn from the cop placed in the magazine is prevented and the yarn end is positively taken off from the yarn end holding member of the cop container, and at the same time, the yarn end of the placed cop is assuredly sucked to the suction nozzle of the predetermined magazine.

DETAILED DESCRIPTION OF THE INVENTION

The apparatus of the present invention will now be described in detail with reference to the accompanying drawings.

Figure 3:
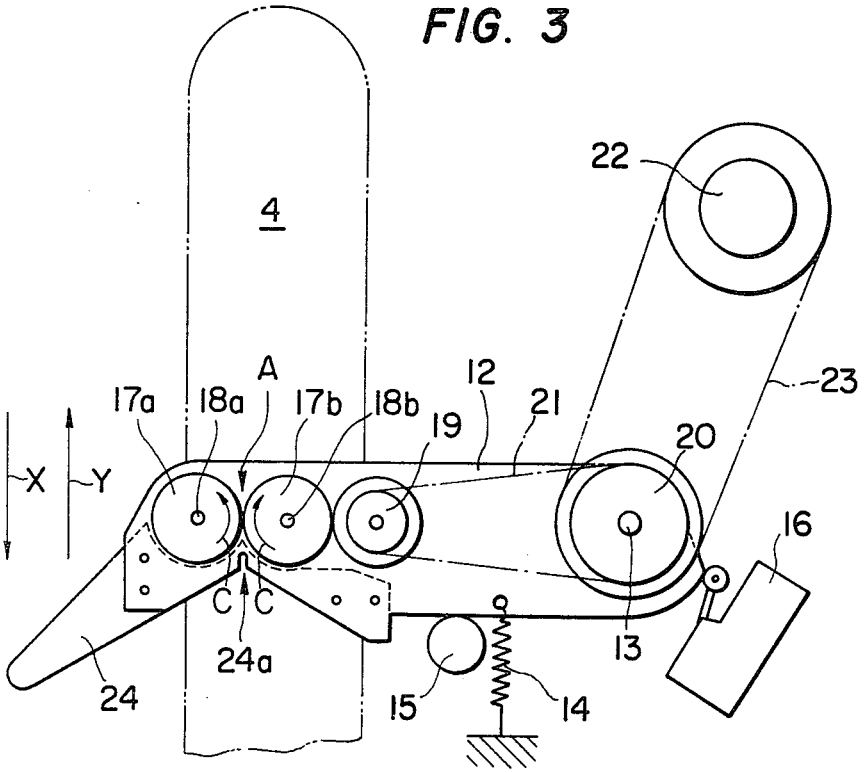
FIG. 3 is a bottom view showing a guide and rollers in the apparatus of the present invention.
Figure 4:
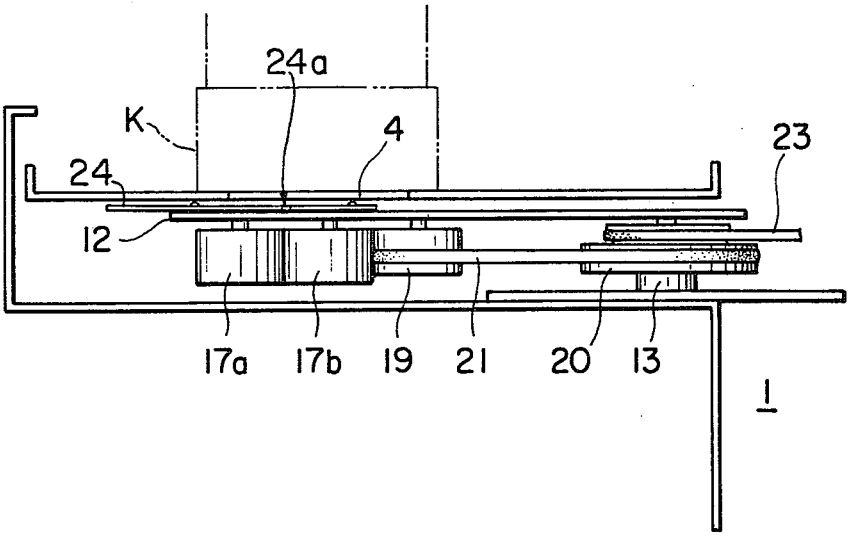
FIG. 4 is a front view showing the guide and rollers shown in FIG. 3.

Referring to FIGS. 3 and 4, a moving plate 12 is pivoted on a shaft 13 on the lower face of a bottom plate 8 having a long hole 4 of a cop supplying truck 1 and is arranged across the long hole 4, and this moving plate 12 is urged by a spring 14 to settle at the position of a stopper 15.

In the normal state, the moving plate 12 is kept stationary at the position shown in FIG. 3 and is prevented from turning, and only when the cop is stopped between the long hole 4 and the magazine 5 for some reason or other on the cop being placed in the magazine, the moving plate 12 turns in the clockwise direction with the shaft 13 being as the center against the spring 14, whereby a limit switch 16 is actuated to stop driving of the entire apparatus.

On the lower face of the moving plate 12, a pair of rollers **17*a* and 17*b* are pivoted in vertical shafts 18 *a* and 18*b*, respectively, and the line connecting these shafts 18*a* and 18*b* to each other is set at a right angle to the direction Y of delivery of the cop container and the rollers 17*a* and 17*b* fall in contact with each other at point A. A pulley 19 is disposed to drive the rollers 17*a* and 17*b*, and a belt 21 is hung between this pulley 19 and another pulley 20 mounted on the lower face of the end portion of the moving plate 12. The pulley 19 is rotated through a belt 23, the pulley 20 and the belt 21 by a motor 22 mounted on the body portion of the cop supplying truck, whereby the roller 17*b* having a surface contact relation to the pulley 19 is rotated in a direction indicated by an arrow and at the same time, the roller 17*a* having a surface contact relation to the roller 17*b*** is rotated in a direction indicated by an arrow.

Figure 1:
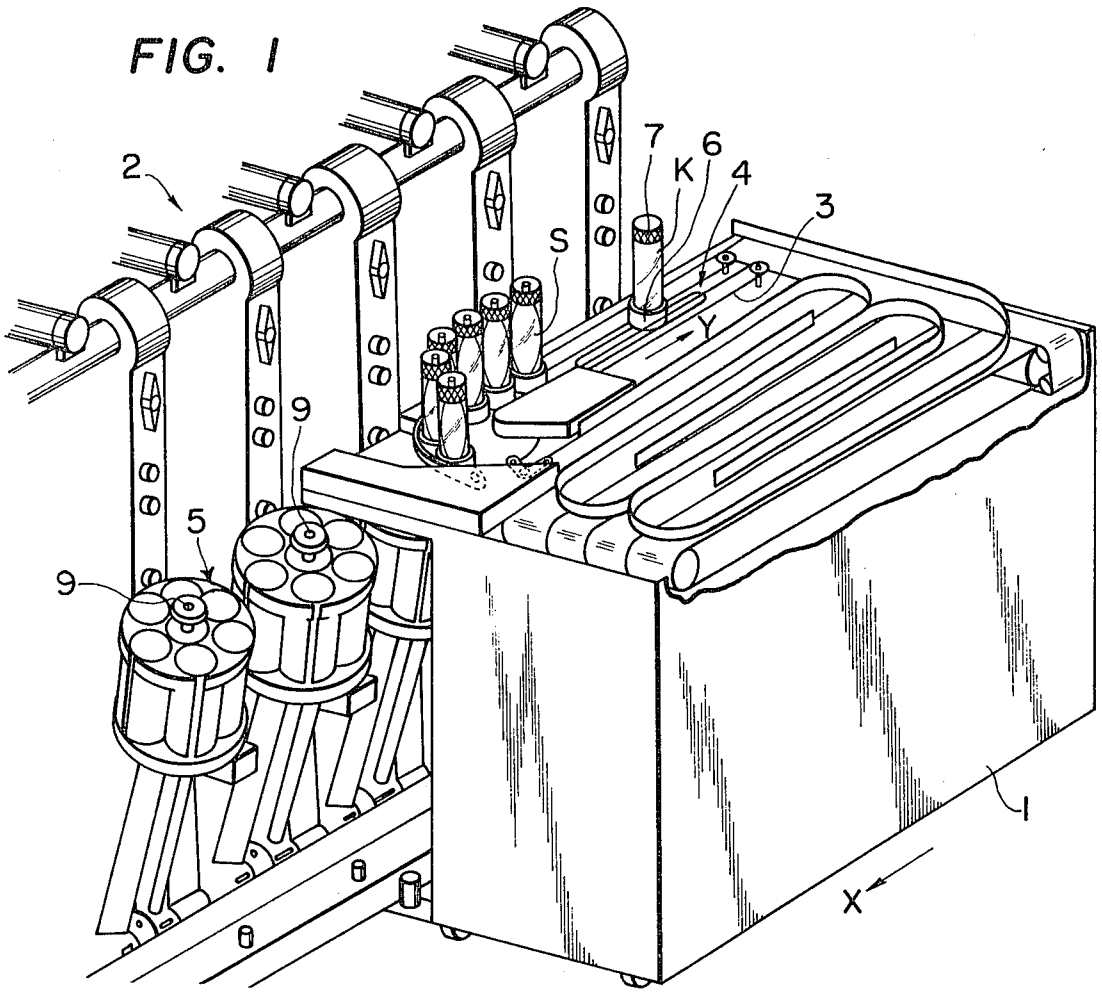
FIG. 1 is a perspective view showing the relation between the cop supplying truck and the winding unit.
Figure 2:
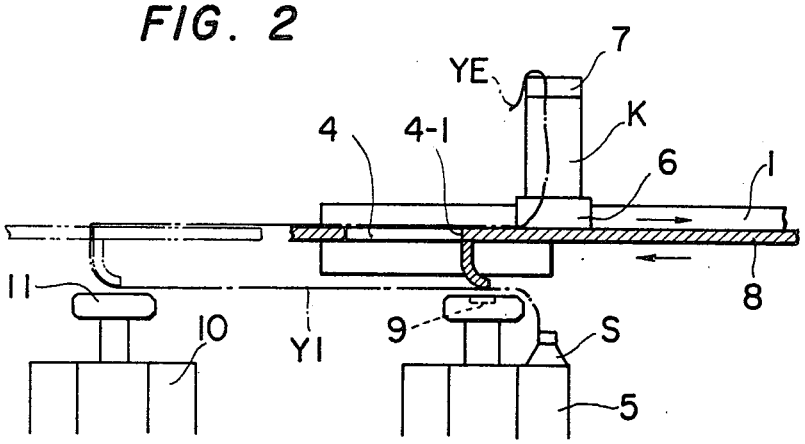
FIG. 2 is a diagram illustrating the phenomenon of spreading of the yarn between the adjacent magazines.

A yarn end guide 24 is secured to the moving plate 12 and the trough 24*a* of the guide face of the yarn end guide 24 is located at the contact point of the rollers 17*a* and 17*b*. The contact point A and trough 24*a* are set at a position slightly deviating from the center of the long hole 4 in the widthwise direction toward the left, that is, toward the side of the winding unit. More specifically, the magazine can of the magazine is inclined toward the cop supplying truck as shown in FIG. 1 and the trough 24*a* of the guide 24 is located at a position deviating from the center of the long hole 4 toward the winding unit. By this arrangement, there can be attained a feature in which when the yarn end of the cop placed in the magazine can is picked up by the guide and the yarn being spread between the cop container on the cop supplying truck and the cop being placed in the magazine can with movement of the cop supplying truck is guided by the guide 24, the yarn is located just above a suction pipe 9 of the magazine at the moment when the yarn end is taken off and set free from the yarn end holding member 7 on the upper portion of the cop container.

Figure 5:
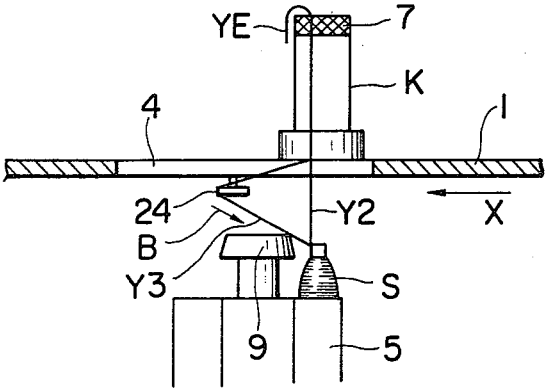
FIG. 5 is a diagram illustrating the yarn end treatment according to the present invention.

In the apparatus having the above-mentioned structure, when the cop is placed in the magazine during travel of the cop supplying truck, the yarn end YE of the cop is held by the yarn end holding member 7 of the cop container K as shown in FIG. 5. Accordingly, the yarn is unwound from the cop and the yarn is spread between the cop 5 in the magazine 5 and the yarn end holding member 7, and in this state, the cop supplying truck runs without stopping. Accordingly, with travel of the cop supplying truck 1 in a direction indicated by arrow X, the guide 24 in the lower portion of the long hole 4 runs while catching the yarn Y2 thereon, and the yarn is temporarily bent as indicated by Y3. During the travel of the cop supplying truck, the rollers 17*a* and 17*b* mounted on the moving plate 12 shown in FIG. 12 are always rotated. Accordingly, the yarn end guided by the trough 24*a* of the guide 24 is held by the rollers 17*a* and 17*b* and positively fed in the rotation direction of the rollers. Therefore, while the rollers 17*a* and 17*b* are being delivered to the position shown in FIG. 5, the yarn Y3 is positively fed in a direction indicated by an arrow B and the yarn is not unwound from the cop S, and the yarn end YE is forcibly taken off from the yarn holding member 7 on the upper portion of the cop container K and is sucked to the suction pipe 9.

Incidentally, the length of the yarn end YE of the portion of the yarn held by the yarn end holding member 7 of the cop container should be large enough to attain the state shown in FIG. 5, in which when the rollers 17*a* and 17*b* holding the yarn pass above the suction pipe 9, the yarn is connected at least to the holding member 7, the guide 24 and the cop S.

Figure 6:
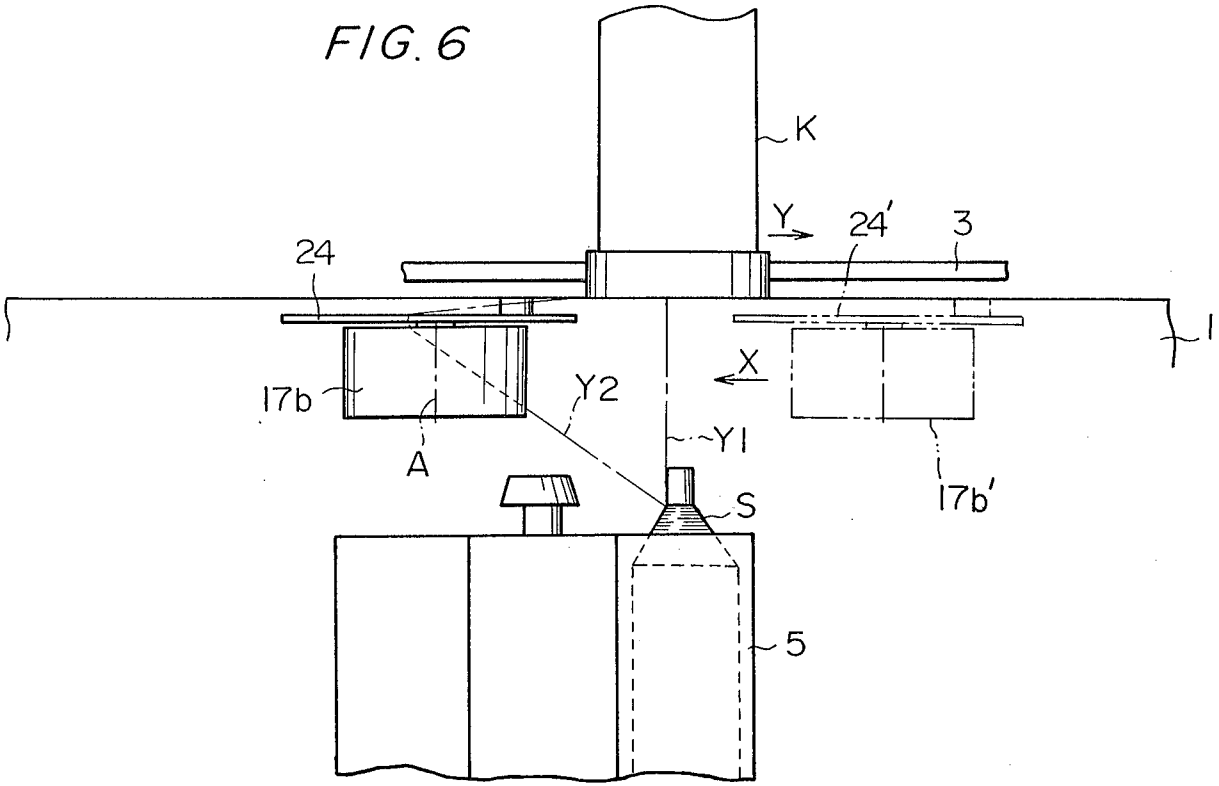
FIG. 6 is an enlarged more detailed view similar to FIG. 5.

More specifically and referring to FIG. 6, the guide plate 24' and rollers 17*a'*, 17*b'* are positioned at the right side of the yarn Y1 which is extending between the cop container K and cop S when the cop is just dropped into the magazine 5. And then, the guide plate and rollers which are secured on the cop supplying truck travel toward the position shown by the solid line and designated 24 and 17*b* in accordance with the movement of the truck in the direction X. Accordingly, the yarn Y1 is engaged by the guide plate 24 to be inserted in the trough 24*a* and the yarn is nipped obliquely extending and crossing the nip line A as the yarn Y2 shown in FIG. 6.

Figure 7:
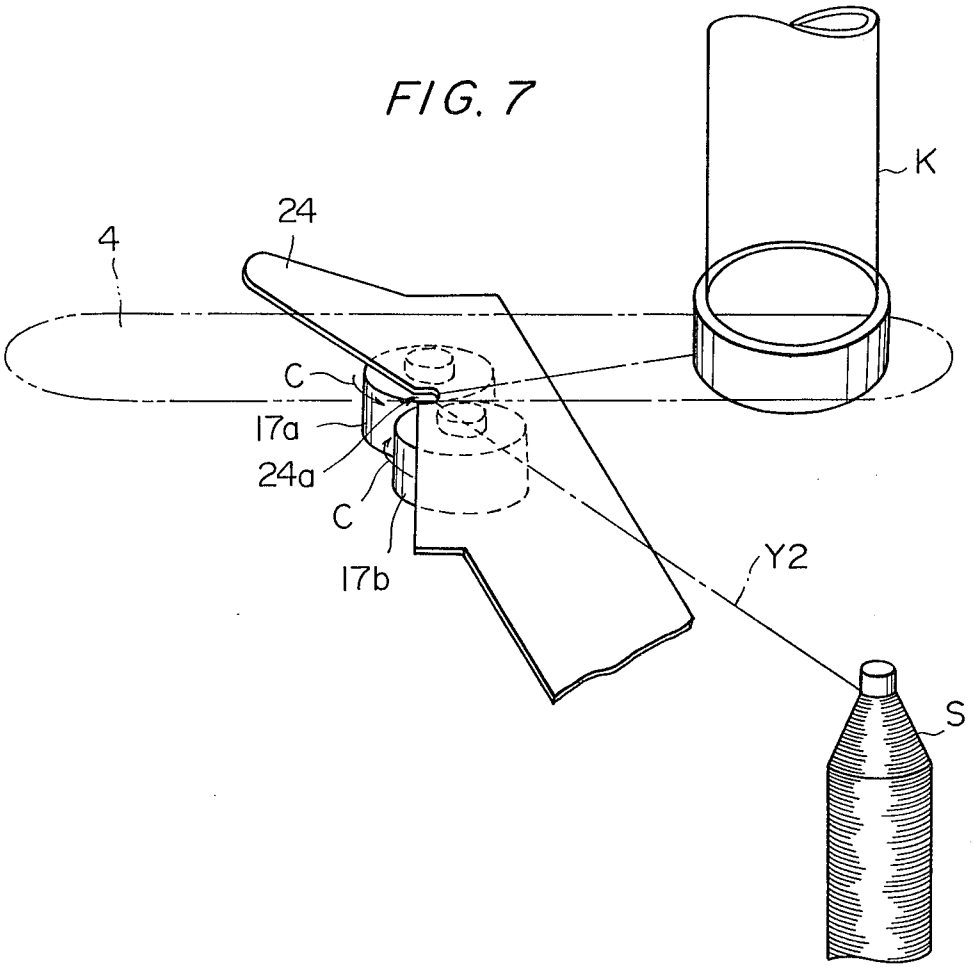
FIG. 7 is a perspective diagram illustrating the engagement of the yarn with a guide and rollers according to the present invention.

That is, it will be known by FIG. 7 the yarn Y2 nipped by a pair of rollers is fed out positively toward the cop side in accordance with the rotation of the rollers in the direction of arrows C, C keeping the cop container K stationary relative to the magazine 5 since the cop container is transferred in the opposite direction of the truck by the belt 3 at the same speed as the speed of the truck.

As will be apparent from the foregoing illustration, according to the present invention, since the yarn spread between the cop placed in the magazine can and the cop container is positively transported by the rollers 17*a* and 17*b* mounted on the lower face of the long hole of the cop supplying truck, the yarn end on the side of the cop container is positively taken off, and occurrence of an undesirable phenomenon often observed in the preceding apparatus, that is, the phenomenon of spreading of the yarn taken off from the cop to the adjacent magazine, is prevented. Thus, the yarn end can be sucked and held on the predetermined suction pipe.

What is claimed is:

1. In cop supplying apparatus for an automatic winding machine wherein a cop supplying truck runs along individual winding units of the automatic winding machine and cops are dropped into magazines of the winding units from the cop supplying truck, without the truck stopping at the individual winding units, through a long hole in a bottom plate of the cop supplying truck and wherein the cops on the cop supplying truck are driven over the long hole at substantially the speed of the cop supplying truck so that their speed at the individual winding units is substantially zero with respect to the winding units, means operable between the cop supplying truck and the magazines of the winding units for preventing spreading of yarn from cops dropped into one magazine from the cop supplying truck to an adjacent magazine.

2. Structure as set forth in claim 1, wherein the means for preventing yarn spread between magazines includes a pair of driven rollers supported by the cop supply truck for receiving a yarn end of a cop supplying truck and feeding the received yarn end between the rollers.

3. Structure as set forth in claim 2, wherein the means for preventing yarn spread between magazines includes a notched guide carried by the cop supplying truck for receiving and guiding the yarn end of the cop dropped through the long hole in the cop supplying truck.

4. Structure as set forth in claim 3, and further including an elongated flat plate mounted on the cop supplying truck for pivotal movement over the long hole in the cop supplying truck which is resiliently urged against a stop whereby the flat plate extends in its elongated direction substantially perpendicular to the direction of extend of the long hole in the cop supplying truck and wherein the rollers and guide are mounted on the flat plate over the long hole.

5. Structure as set forth in claim 4, wherein the rollers in contact with each other and the guide notch are positioned off center transversley of the long hole through the cop supplying truck.

* * * * *